US009972260B2

(12) United States Patent
Onishi et al.

(10) Patent No.: US 9,972,260 B2
(45) Date of Patent: May 15, 2018

(54) DISPLAY DEVICE AND DRIVING METHOD THEREOF

(71) Applicant: Panasonic Liquid Crystal Display Co., Ltd., Hyogo (JP)

(72) Inventors: Toshiki Onishi, Osaka (JP); Iwane Ichiyama, Osaka (JP); Tatsuhiro Inuzuka, Kanagawa (JP)

(73) Assignee: PANASONIC LIQUID CRYSTAL DISPLAY CO., LTD., Hyogo (JP)

( * ) Notice: Subject to any disclaimer, the term of this patent is extended or adjusted under 35 U.S.C. 154(b) by 55 days.

(21) Appl. No.: 15/261,255

(22) Filed: Sep. 9, 2016

(65) Prior Publication Data

US 2016/0379580 A1 Dec. 29, 2016

Related U.S. Application Data

(63) Continuation of application No. PCT/JP2014/001386, filed on Mar. 11, 2014.

(51) Int. Cl.
*G09G 5/10* (2006.01)
*G09G 3/36* (2006.01)
(Continued)

(52) U.S. Cl.
CPC ..... *G09G 3/3618* (2013.01); *G09G 3/20* (2013.01); *G09G 3/2092* (2013.01); *G09G 5/003* (2013.01);
(Continued)

(58) Field of Classification Search
CPC .... G09G 3/3618; G09G 3/2092; G09G 5/003; G09G 3/20; G09G 2320/103;
(Continued)

(56) References Cited

U.S. PATENT DOCUMENTS

2012/0212521 A1 8/2012 Yamauchi et al.
2012/0218246 A1 8/2012 Ueda et al.
(Continued)

FOREIGN PATENT DOCUMENTS

JP 2011-170386 9/2011
JP 2013-190777 9/2013
(Continued)

OTHER PUBLICATIONS

International Search Report dated May 27, 2014 in International (PCT) Application No. PCT/JP2014/001386.

*Primary Examiner* — Adam R Giesy
(74) *Attorney, Agent, or Firm* — Wenderoth, Lind & Ponack, L.L.P.

(57) ABSTRACT

A display device including a processor that includes a first display mode in which the processor displays the image on the display screen; and a second display mode in which the processor displays the image on the display screen from the image data received by the processor. The display device further includes a calculator that calculates a blanking period between a writing end time point of the internal image data corresponding to a final frame immediately before switching from the first display mode to the second display mode and a writing start time point of the image data corresponding to an initial frame immediately after switching from the first display mode to the second display mode, and an adjuster that adjusts at least one of a vertical retrace period, a horizontal retrace period, and a clock frequency, which correspond to the internal image data, depending on the blanking period.

8 Claims, 17 Drawing Sheets

(51) Int. Cl.
*G09G 3/20* (2006.01)
*G09G 5/00* (2006.01)

(52) U.S. Cl.
CPC ... *G09G 2310/061* (2013.01); *G09G 2310/08* (2013.01); *G09G 2320/0247* (2013.01); *G09G 2320/0626* (2013.01); *G09G 2320/10* (2013.01); *G09G 2320/103* (2013.01); *G09G 2330/021* (2013.01)

(58) Field of Classification Search
CPC ..... G09G 2320/10; G09G 2320/0247; G09G 2310/08; G09G 2310/061; G09G 2330/021; G09G 2320/0626
See application file for complete search history.

(56) References Cited

U.S. PATENT DOCUMENTS

| | | | | |
|---|---|---|---|---|
| 2012/0327137 | A1 | 12/2012 | Saitoh | |
| 2013/0038639 | A1* | 2/2013 | Han ..... | G09G 3/20 345/690 |
| 2013/0235014 | A1 | 9/2013 | Lee et al. | |
| 2014/0368484 | A1 | 12/2014 | Tanaka et al. | |

FOREIGN PATENT DOCUMENTS

| | | |
|---|---|---|
| WO | 2011/052472 | 5/2011 |
| WO | 2011/114583 | 9/2011 |
| WO | 2013/115088 | 8/2013 |

* cited by examiner

DISPLAY DEVICE AND DRIVING METHOD THEREOF

CROSS-REFERENCE TO RELATED APPLICATION

This application is a bypass continuation of international patent application PCT/JP2014/001386, filed: Mar. 11, 2014 designating the United States of America, the entire disclosure of which is incorporated herein by reference.

TECHNICAL FIELD

The present disclosure relates to a display device, particularly to a display device applied to a display system having a PSR (Panel Self Refresh) function.

BACKGROUND

The display system includes a system unit that receives a video signal output from an external signal source (host) and a display device that receives the video signal, output from the system unit, to display an image. The display device includes a display panel that displays the image, a drive circuit that drives the display panel, and a control circuit that controls the drive of the drive circuit. In recent years, a PSR technology is proposed as a technology of reducing power consumption of the whole display system (See Japanese unexamined published patent application No. 2013-190777).

In the PSR technology, in a case where image data (frame image data) in units of frames in the video signal output from the host is a still image, frame image data output operation of the system unit is stopped, and the display is performed using the frame image data stored in a storage unit of the control circuit. In the display system having the PSR function, the output operation of the system unit can be stopped while the still image is displayed, so that power consumption of the display system can be reduced as a whole.

However, in the display device applied to the display system, there is a problem in that display quality is degraded by a flicker. A principle of generation of the flicker will be described below. FIGS. 3 and 17 are views illustrating a principle of the generation of the flicker.

In the PSR technology, in order to reduce the power consumption, a drive frequency at which the still image is displayed is set lower than a drive frequency at which a moving image is displayed. While the system unit is in a stopped state, the control circuit outputs the frame image data from the storage unit in asynchronization with the system unit. Therefore, timing at which the frame image data in the video signal output from the host is switched from a still image to a moving image deviates from timing at which a frame period of a still image output from the storage unit is ended. When the deviation is generated, a vertical retrace period (blanking period BR1) is lengthened in the frame image data (the image data of a frame 3 in FIG. 3) indicating a still image immediately before the switching from a PSR mode to a normal mode. When the blanking period becomes longer than or equal to a predetermined period (for example, a blanking period BR0 in FIG. 3), in a frame (a frame 3 in FIG. 3) immediately before the PSR mode is switched to the normal mode, a potential (pixel potential) written in a pixel is lowered less than or equal to a predetermined value, and a display luminance is largely lowered (refer to FIG. 17). Then, in the frame (a frame E in FIG. 3) immediately after the switching from the PSR mode to the normal mode, a change in display luminance (display luminance difference) is increased, and recognized as the flicker by human's eyes.

SUMMARY

The present disclosure has been made in view of the above circumstances and an object of the present disclosure is to improve the display quality in the display device to which the PSR function is applied.

In one general aspect, the instant application describes a display device including a processor that performs processing on each frame of image data that includes plural frames, the display device displaying an image on a display screen based on the image data processed by the processor, the processor receiving the image data, a first control signal indicating a command to stop output of the image data, and a second control signal indicating a command to perform the output of the image data, and a memory in which the image data received immediately before stop of transmission of the image data is stored as internal image data. The processor includes a first display mode in which the processor displays the image on the display screen from the internal image data after the processor receives the first control signal; and a second display mode in which the processor displays the image on the display screen from the image data received by the processor after the processor receives the second control signal. The display device further includes a calculator that calculates a blanking period between a writing end time point of the internal image data corresponding to a final frame immediately before switching from the first display mode to the second display mode and a writing start time point of the image data corresponding to an initial frame immediately after switching from the first display mode to the second display mode, and an adjuster that adjusts at least one of a vertical retrace period, a horizontal retrace period, and a clock frequency, which correspond to the internal image data, depending on the blanking period.

The above general aspect may include one or more of the following features. The adjuster may keep a writing time duration corresponding to the internal image data constant, and may adjust the vertical retrace period corresponding to the internal image data.

The adjuster may adjust at least one of the vertical retrace period, the horizontal retrace period, and the clock frequency such that the vertical retrace period corresponding to the internal image data corresponding to the final frame is shorter than the blanking period.

In one general aspect, the instant application describes a display device including a processor that performs processing on each frame of image data that includes plural frames, the display device displaying an image on a display screen based on the image data processed by the processor, the processor receiving the image data, a first control signal indicating a command to stop output of the image data, and a second control signal indicating a command to perform the output of the image data, and a memory in which the image data received immediately before stop of transmission of the image data is stored as internal image data. The processor includes a first display mode in which the processor displays the image on the display screen from the internal image data after the processor receives the first control signal, and a second display mode in which the processor displays the image on the display screen from the image data received by the processor after the processor receives the second control signal. The display device further includes a calculator that calculates a blanking period between a writing end time point of the internal image data corresponding to a final frame immediately before switching from the first display mode to the second display mode and a writing start time point of the image data corresponding to an initial frame immediately after switching from the first display mode to the second display mode, and an interpolator that interpolates interpolation image data based on the internal image data in the blanking period when the blanking period is larger than a predetermined period.

The interpolator may further adjust at least one of the vertical retrace period, the horizontal retrace period, and the clock frequency, which correspond to the interpolation image data, depending on the blanking period.

The interpolator may interpolate the interpolation image data when the blanking period becomes equal to or larger than a half of one frame period of the internal image data.

The interpolator may adjust at least one of the vertical retrace period, the horizontal retrace period, and the clock frequency such that the vertical retrace period corresponding to the internal image data corresponding to the final frame is shorter than the blanking period.

In one general aspect, the instant application describes a method for driving a display device including a processor that performs processing on each frame of image data that includes plural frames, the display device displaying an image on a display screen based on the image data processed by the processor. The method includes receiving, with the processor, the image data, a first control signal indicating a command to stop output of the image data, and a second control signal indicating a command to perform the output of the image data, and storing as internal image data in a memory the image data received immediately before stop of transmission of the image data. The processor includes a first display mode in which the processor displays the image on the display screen from the internal image data after the processor receives the first control signal; and a second display mode in which the processor displays the image on the display screen from the image data received by the processor after the processor receives the second control signal. The processor calculates a blanking period between a writing end time point of the internal image data corresponding to a final frame immediately before switching from the first display mode to the second display mode and a writing start time point of the image data corresponding to an initial frame immediately after switching from the first display mode to the second display mode, and adjusts at least one of a vertical retrace period, a horizontal retrace period, and a clock frequency, which correspond to the internal image data, depending on the blanking period.

In the display device of the present disclosure and driving method thereof, the display luminance difference can be reduced when the PSR mode is switched to the normal mode. Therefore, the display quality can be improved in the display device to which the PSR function is applied.

DETAILED DESCRIPTION

Hereinafter, an exemplary embodiment of the present disclosure will be described with reference to the drawings. A liquid crystal display device is described below by way of example. However, a display device according to the present disclosure is not limited to the liquid crystal display device, but may be an organic EL display device and the like.

Figure 1:
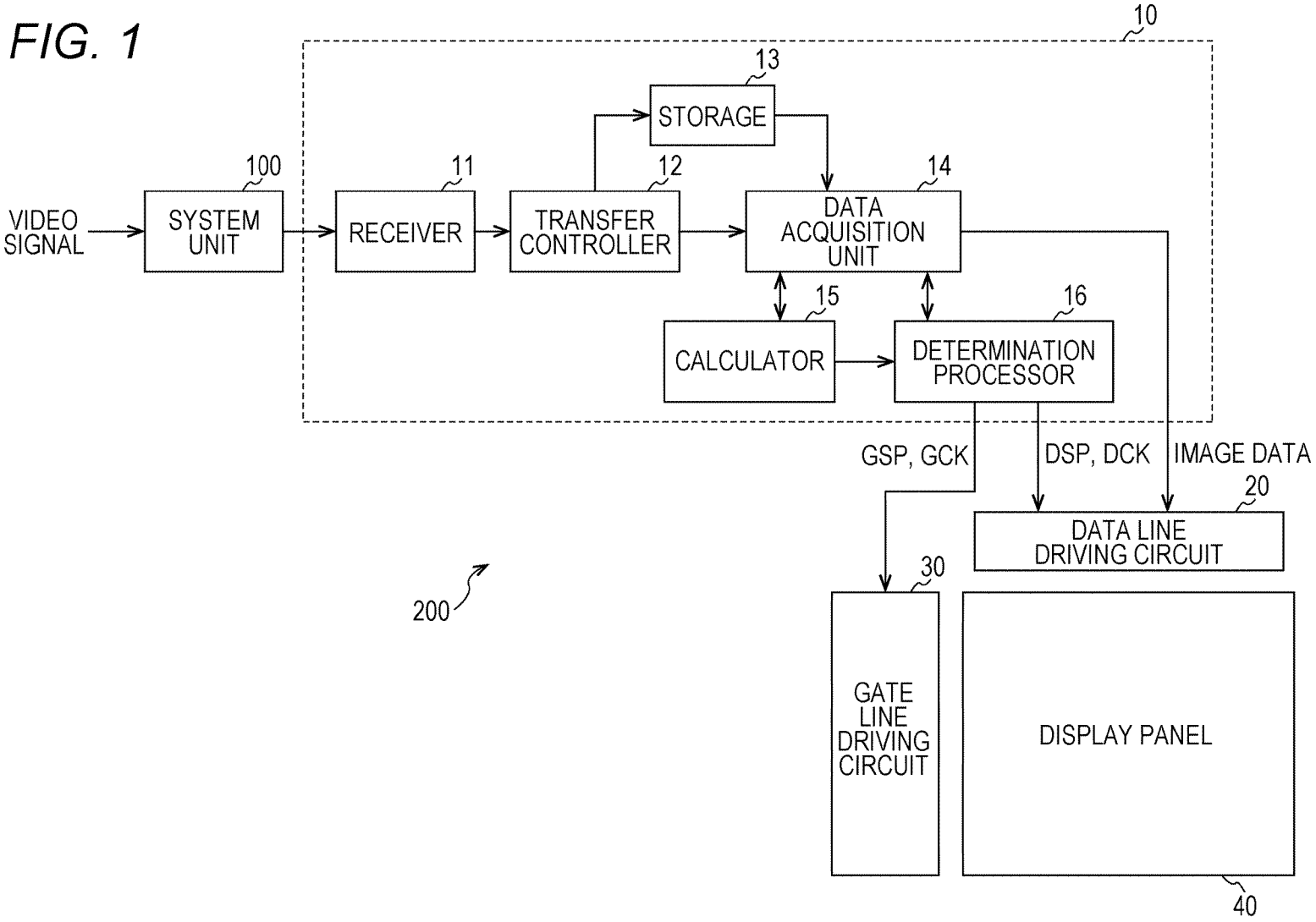
FIG. 1 is a view illustrating a schematic configuration of a display system according to an exemplary embodiment of the present disclosure.

FIG. 1 is a view illustrating a schematic configuration of a display system according to an exemplary embodiment of the present disclosure. The display system includes a system unit 100 and a liquid crystal display device 200. Based on a video signal supplied from an external signal source (host), the system unit 100 determines whether an image indicated by the image data is a moving image or a still image in each frame. The system unit 100 controls operation of the system unit 100 based on a determination result. The liquid crystal display device 200 performs processing of displaying the image on a display screen of a display panel 40 based on the image data supplied from the system unit 100. Specific configurations of the system unit 100 and liquid crystal display device 200 will be described below.

Figure 2:
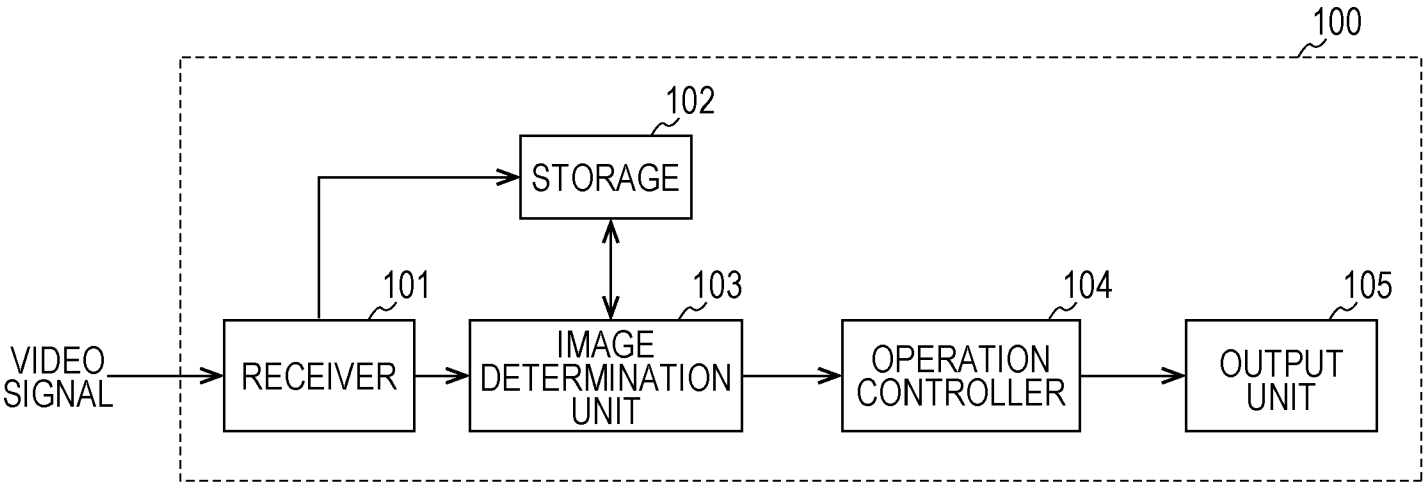
FIG. 2 is a block diagram illustrating a specific configuration of a system unit.

FIG. 2 is a block diagram illustrating a specific configuration of the system unit 100. The system unit 100 includes a receiving unit 101, a storage unit 102, an image determination unit 103, an operation controller 104, and an output unit 105.

The receiving unit 101 receives a video signal output from the host. The receiving unit 101 transfers the received video signal to the storage unit 102 and the image determination unit 103 in each frame. Hereinafter, the video signal in one frame unit is referred to as frame image data (also referred to as image data).

The frame image data transferred from the receiving unit 101 is temporarily stored in the storage unit 102. For example, the storage unit 102 is configured as a frame memory.

The image determination unit 103 determines whether an image (frame image) indicated by the frame image data transferred from the receiving unit 101 is a moving image or a still image. Specifically, the image determination unit 103 determines whether a frame image of a current frame is the moving image or the still image based on the frame image data of the current frame transferred from the receiving unit 101 and the frame image data of a last frame or pieces of frame image data of a plurality of precedent frames, the frame image data and the pieces of frame image data being stored in the storage unit 102. For example, the image determination unit 103 detects a difference between the frame image data of the current frame and the frame image data of the last frame, determines that the current frame image is the moving image when the detected difference is larger than or equal to a threshold, and determines that the current frame image is the still image when the detected difference is less than the threshold. There is no limitation to the moving image and still image determination method, but any known method can be used. The image determination unit 103 transfers the frame image data of the current frame acquired from the receiving unit 101 to the operation controller 104 together with the determination result.

The operation controller 104 controls the operation of the system unit 100 based on the frame image data and the determination result, which are acquired from the image determination unit 103. Specifically, when the frame image is the moving image, the operation controller 104 causes the output unit 105 to output the frame image data. On the other hand, when the frame image is the still image, the operation controller 104 stops the frame image data output operation of the output unit 105.

Hereinafter, a case that the system unit 100 outputs the frame image data (moving image) is referred to as a normal mode, and a case that the system unit 100 does not output the frame image data (still image) is referred to as a PSR mode (low power consumption mode).

In a case where the frame image is switched from the moving image to the still image, the operation controller 104 transfers the frame image data corresponding to the still image to the output unit 105 while a control signal for putting the PSR mode into an on state, namely, a first control signal PSR_ON indicating a command to stop the output of the frame image data is provided to the frame image data.

In a case where the frame image is switched from the still image to the moving image, the operation controller 104 transfers the frame image data corresponding to the moving image to the output unit 105 while a control signal for putting the PSR mode into an off state (normal mode), namely, a second control signal PSR_OFF indicating a command to execute the output of the frame image data is provided to the frame image data.

After the frame image is switched from the still image to the moving image, the operation controller 104 transfers only the frame image data to the output unit 105 while the frame image data indicating the moving image is input to the system unit 100 (normal mode period).

The operation controller 104 is not limited to the above configuration. For example, the operation controller 104 may provide a flag (for example, flag "0") indicating the moving image or a flag (for example, flag "1") indicating the still image to each piece of frame image data based on the determination result. Specifically, the operation controller 104 may generate a packet including the flag and the frame image data, and sequentially output the generated packet from the output unit 105.

The output unit 105 outputs the frame image data, the frame image data to which the first control signal PSR_ON is provided, and the frame image data to which the second control signal PSR_OFF is provided, all the pieces of frame image data being acquired from the operation controller 104, to the liquid crystal display device 200.

In the PSR mode period, the operation controller 104 may stop the operation to transfer the frame image data to the output unit 105, or the operation controller 104 may stop the frame image data output operation of the output unit 105. Because the video signal is continuously input in the PSR mode period, the determination processing of the image determination unit 103 and the control processing of the operation controller 104 are continued.

In the above configuration of the system unit 100, the image data output operation of the system unit 100 is stopped while the host supplies the video signal (image data) corresponding to the still image. Therefore, the power consumption of the system unit 100 can be reduced.

The system unit 100 outputs various timing signals (such as a vertically synchronous signal, a horizontally synchronous signal, and a clock signal) to the liquid crystal display device 200.

The specific configuration of the liquid crystal display device 200 will be described with reference to FIG. 1. The liquid crystal display device 200 includes an image processing controller 10, a data line driving circuit 20, a gate line driving circuit 30, and the display panel 40.

The image processing controller 10 performs processing of reducing the display luminance difference based on a characteristic (the moving image or still image) of the frame image. The display luminance means apparent brightness when the frame image is displayed on the display screen of the display panel 40.

Based on various timing signals supplied from the system unit 100, the image processing controller 10 generates various control signals (such as a data start pulse DSP, a data clock DCK, a gate start pulse GSP, and a gate clock GCK) in order to control the operations of the data line driving circuit 20 and gate line driving circuit 30. The image processing controller 10 outputs the generated data start pulse DSP and data clock DCK to the data line driving circuit 20. The image processing controller 10 outputs the generated gate start pulse GSP and gate clock GCK to the gate line driving circuit 30. As a detail will be described later, the image processing controller 10 performs processing of adjusting a timing of outputting each of the above various control signals.

Figure 3:
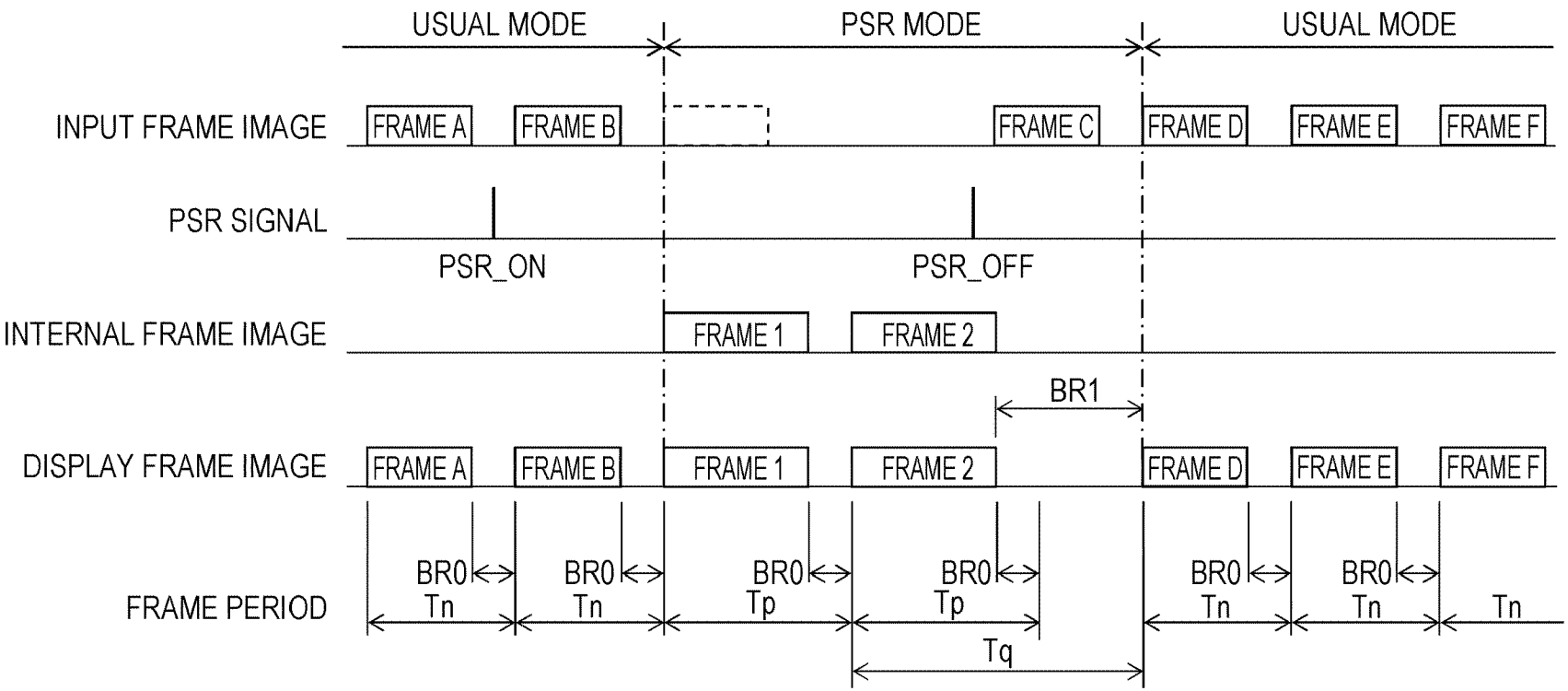
FIG. 3 is an example of various pieces of data input to and output from an image processing controller in time series.

The image processing controller 10 includes a receiving unit 11, a transfer controller 12, a storage unit 13, a data acquisition unit 14, a calculator 15, and a luminance adjuster 16. FIG. 3 illustrates an example of various pieces of data input to and output from the image processing controller 10 in time series. At this point, with reference to FIG. 3, a basic operation of the image processing controller 10 will be described.

The receiving unit 11 receives the frame image data, the frame image data to which the first control signal PSR_ON is provided, and the frame image data to which the second control signal PSR_OFF is provided, all the pieces of frame image data being output from the system unit 100. In FIG. 3, the input frame image indicates the frame image data received by the receiving unit 11, and the PSR signal indicates the first control signal PSR_ON and second control signal PSR_OFF, which are provided to the frame image data. In the example of FIG. 3, the first control signal PSR_ON is provided to the image data of a frame B, and the second control signal PSR_OFF is provided to the image data of a frame C. The receiving unit 11 transfers the received frame image data to the transfer controller 12.

When the frame image indicated by the frame image data acquired from the receiving unit 11 is the still image, the transfer controller 12 transfers the frame image data to the storage unit 13 and the data acquisition unit 14. On the other hand, when the frame image indicated by the frame image data acquired from the receiving unit 11 is the moving image, the transfer controller 12 transfers the frame image data to the data acquisition unit 14.

Specifically, in a case where the first control signal PSR_ON is provided to the frame image data acquired from the receiving unit 11, the transfer controller 12 transfers the frame image data to the storage unit 13 and the data acquisition unit 14. On the other hand, in a case where the second control signal PSR_OFF is provided to the frame image data acquired from the receiving unit 11, the transfer controller 12 transfers the frame image data to the data acquisition unit 14. The transfer controller 12 transfers the frame image data acquired from the receiving unit 11 to the data acquisition unit 14 until the frame image data to which the first control signal PSR_ON is provided is input to the image processing controller 10 since the frame image data to which the second control signal PSR_OFF is provided is input to the image processing controller 10. In the configuration in which the flag ("0" or "1") is provided to the frame image data, the transfer controller 12 performs frame image data transfer processing based on the flag.

In the example of FIG. 3, the transfer controller 12 transfers the image data of the frame B indicating the still image to the storage unit 13 and the data acquisition unit 14, and transfers the image data of each of frames A, C, D, E, and F indicating the moving image to the data acquisition unit 14.

The frame image data, which is transferred from the transfer controller 12 and indicates the still image, is stored in the storage unit 13. For example, the storage unit 13 is configured as a frame memory. The pieces of image data of the frames 1, 2, and 3 in FIG. 3 correspond to the image data (internal image data) of the frame B stored in the storage unit 13.

According to predetermined timing, the data acquisition unit 14 acquires the frame image data transferred from the transfer controller 12 or the frame image data stored in the storage unit 13. The data acquisition unit 14 outputs the acquired frame image data to the data line driving circuit 20.

In the example of FIG. 3, in the normal mode, the data acquisition unit 14 acquires the image data of the frame A when the image data of the frame A is transferred from the transfer controller 12 in the predetermined timing, and the data acquisition unit 14 acquires the image data of the frame B when the image data of the frame B is transferred from the transfer controller 12 in the predetermined timing. In the PSR mode, data acquisition unit 14 acquires the image data of the frame B stored in the storage unit 13 in timing corresponding to a predetermined drive frequency (frame frequency). For example, in the PSR mode, the data acquisition unit 14 acquires the image data in the timing corresponding to the low drive frequency (for example, 48 Hz) rather than the drive frequency (for example, 60 Hz) in the normal mode. Therefore, in the PSR mode, the low frequency drive can be performed to yield the lower power consumption of the liquid crystal display device 200. For example, the drive frequency is set by adjusting a clock frequency.

Thus, the data acquisition unit 14 acquires the image data from the transfer controller 12 or the storage unit 13 based on the timing to receive the second control signal PSR_OFF and the timing to start and end the image data frame period. A display mode, in which the data acquisition unit 14 acquires the frame image data indicating the moving image and the display operation is performed based on the frame image data, corresponds to the normal mode (second display mode). In FIG. 3, the period including the frames A and B and the period including the frames D, E and F become the normal mode. On the other hand, a display mode, in which the data acquisition unit 14 acquires the frame image data indicating the still image and the display operation is performed based on the frame image data, corresponds to the PSR mode (first display mode). In FIG. 3, the period including the frames 1 and 2 becomes the PSR mode.

The calculator 15 calculates a vertical retrace period (blanking period) in the frame image data indicating the still image at the time immediately before the display mode is switched from the PSR mode to the normal mode. Specifically, the calculator 15 calculates the period (blanking period) from a writing end time point of the frame image data (corresponding to the still image), which is acquired by the data acquisition unit 14 and stored in the storage unit 13, to a writing start time point of the frame image data (corresponding to the moving image) that is acquired next from the transfer controller 12 by the data acquisition unit 14*m*, when the receiving unit 11 receives the second control signal PSR_OFF.

In the example of FIG. 3, the calculator 15 calculates a blanking period BR1 from a writing end time point of the image data of the frame 2, the image data being acquired by the data acquisition unit 14, to a writing start time point of the image data of the frame D, the image data being acquired next from the transfer controller 12 by the data acquisition unit 14 when the receiving unit 11 receives the second control signal PSR_OFF. The calculator 15 outputs the calculated blanking period BR1 to the luminance adjuster 16. When the second control signal PSR_OFF is received, the calculator 15 can calculate the blanking period BR1 based on a reception position of the second control signal PSR_OFF relative to the frame period Tp of the frame image data (corresponding to the frame 2) indicating the still image.

Figure 17:
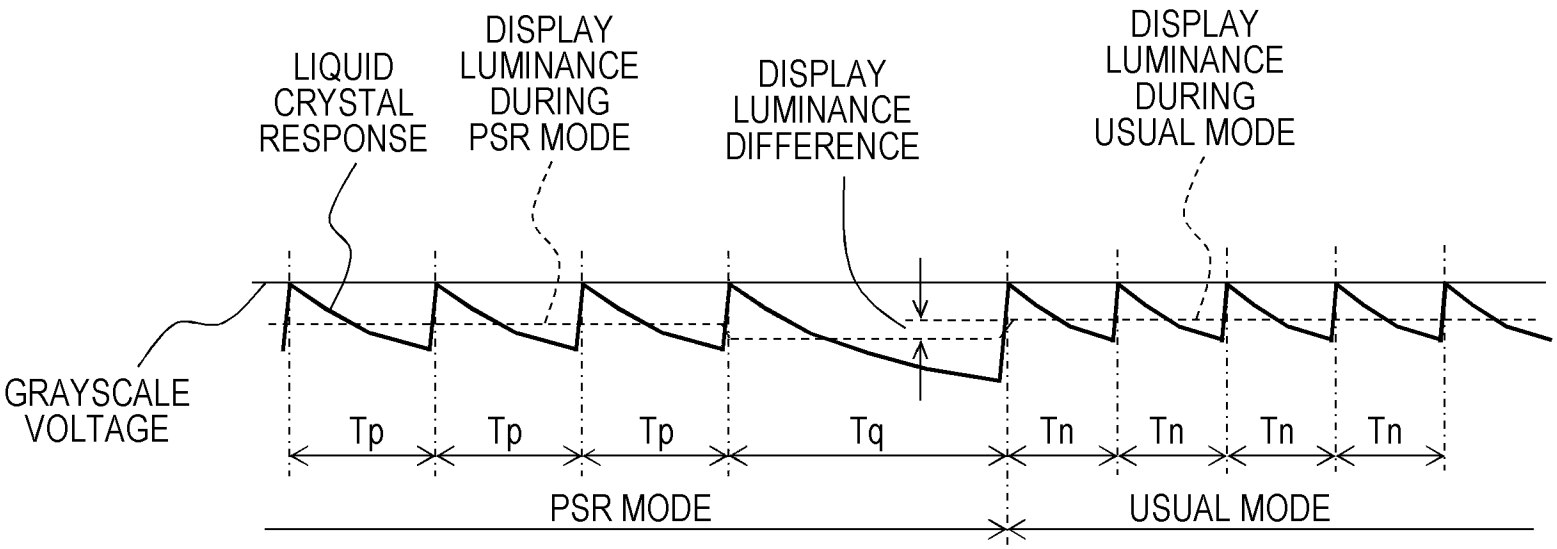
FIG. 17 is a plan view illustrating a specific configuration of a conventional display panel.

At this point, when the blanking period BR1 becomes longer, as illustrated in FIG. 17, the display luminance is lowered, and the flicker is generated due to the display luminance difference. For example, in FIG. 3, as the blanking period BR1 is lengthened, a difference (BR1-BR0) with the blanking period BR0 in another frame increases, and the display luminance difference increases. Thus, the display luminance decreasing amount and the display luminance difference are correlated with the length of the blanking period.

The determination processor 16 performs processing of reducing the display luminance difference. Specifically, based on the blanking period BR1 acquired from the calculator 15, the determination processor 16 generates a control signal in order to adjust at least one of a vertical retrace period of the frame image data, a horizontal retrace period of the frame image data, and a clock frequency, and outputs the generated control signal (for example, a data start pulse DSP, a data clock DCK, a gate start pulse GSP, and a gate clock GCK) to the data line driving circuit 20 and the gate line driving circuit 30. For example, the determination processor 16 generates the control signal in which operating timing of the data start pulse DSP, data clock DCK, gate start pulse GSP, and gate clock GCK, which are generated in the image processing controller 10, is adjusted according to the blanking period BR1. And the determination processor 16 outputs the determination result to the data acquisition unit 14. A specific configuration example of the determination processor 16 will be described later.

The data line driving circuit 20 supplies a grayscale voltage to a plurality of data lines DL based on the control signal (data start pulse DSP, data clock DCK and the like) output from the determination processor 16 and the frame image data (digital data) output from the luminance adjuster 14. Because a known configuration can be applied to the configuration of the data line driving circuit 20, the description is omitted.

The gate line driving circuit 30 sequentially supplies a gate signal to a plurality of gate lines GL based on the control signal (the gate start pulse GSP, gate clock GCK and the like) output from the image processing controller 16. Because a known configuration can be applied to the configuration of the gate line driving circuit 30, the description is omitted.

Figure 4:
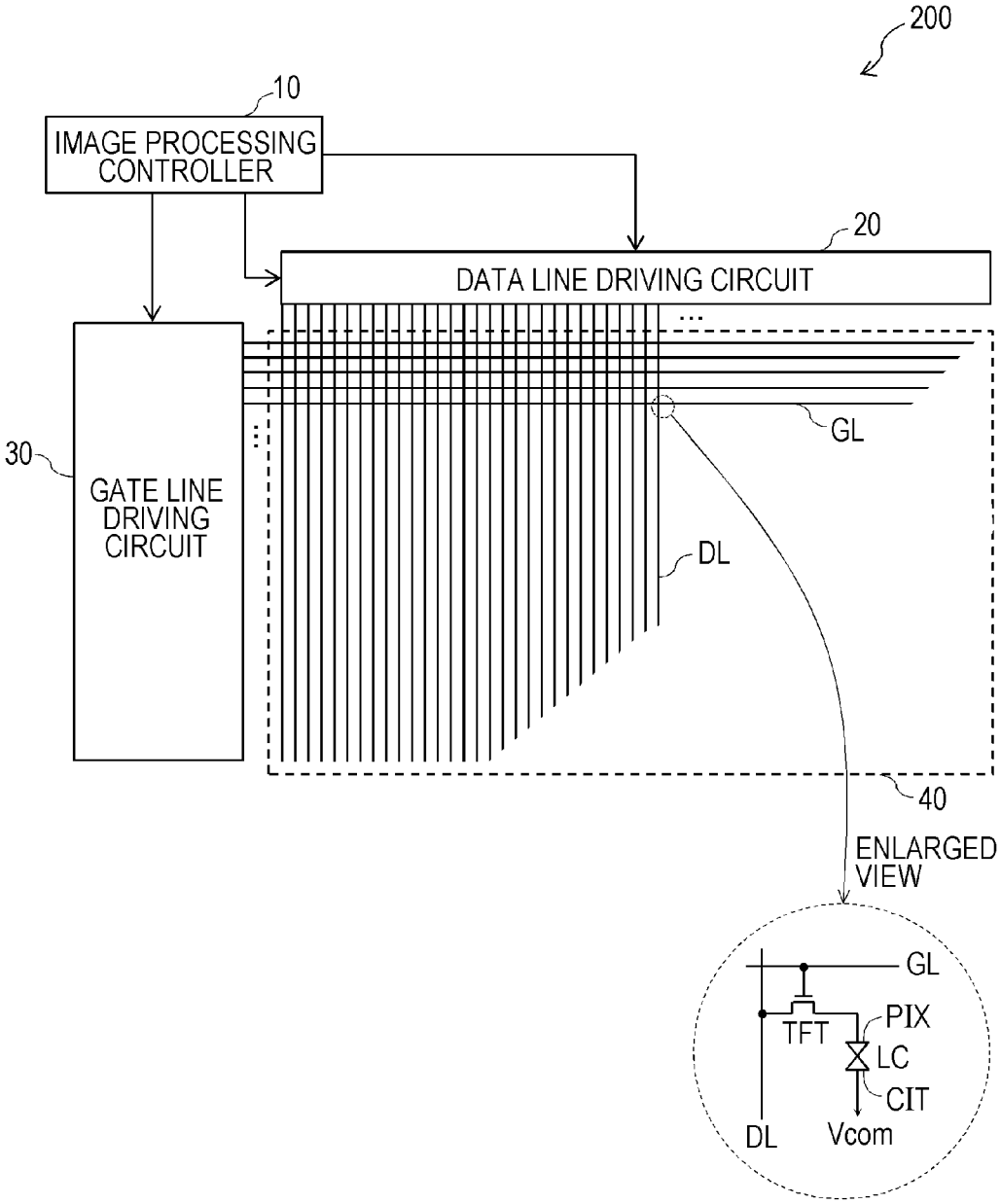
FIG. 4 is a plan view illustrating a specific configuration of the display panel.

FIG. 4 is a plan view illustrating a specific configuration of the display panel 40. The display panel 40 includes a Thin Film Transistor substrate (TFT substrate) (not illustrated), a Color Filter substrate (CF substrate) (not illustrated), and a liquid crystal layer LC that is sandwiched between both the substrates. The plurality of data lines DL connected to the data line driving circuit 20 and the plurality of gate lines GL connected to the gate line driving circuit 30 are provided in the TFT substrate, and a thin film transistor TFT is provided in each intersection portion of the data line DL and gate line GL. In the display panel 40, a plurality of pixels are arranged into a matrix shape (a row direction and a column direction) according to the intersection portions. The display panel 40 also includes a pixel electrode PIT and a common electrode CIT according to each pixel. The display panel 40 puts the thin film transistor TFT into the on state using the gate signal supplied to the gate line GL, and displays the image on the display screen according to the grayscale voltage applied to the pixel electrode PIT through the data line DL. The data line driving circuit 20 and the gate line driving circuit 30 may be formed on the TFT substrate. The display panel 40 is not limited to the above configuration, but a known configuration can be applied to the display panel 40.

A specific configuration example of the determination processor 16 will be described below.

First Exemplary Embodiment

Figure 5:
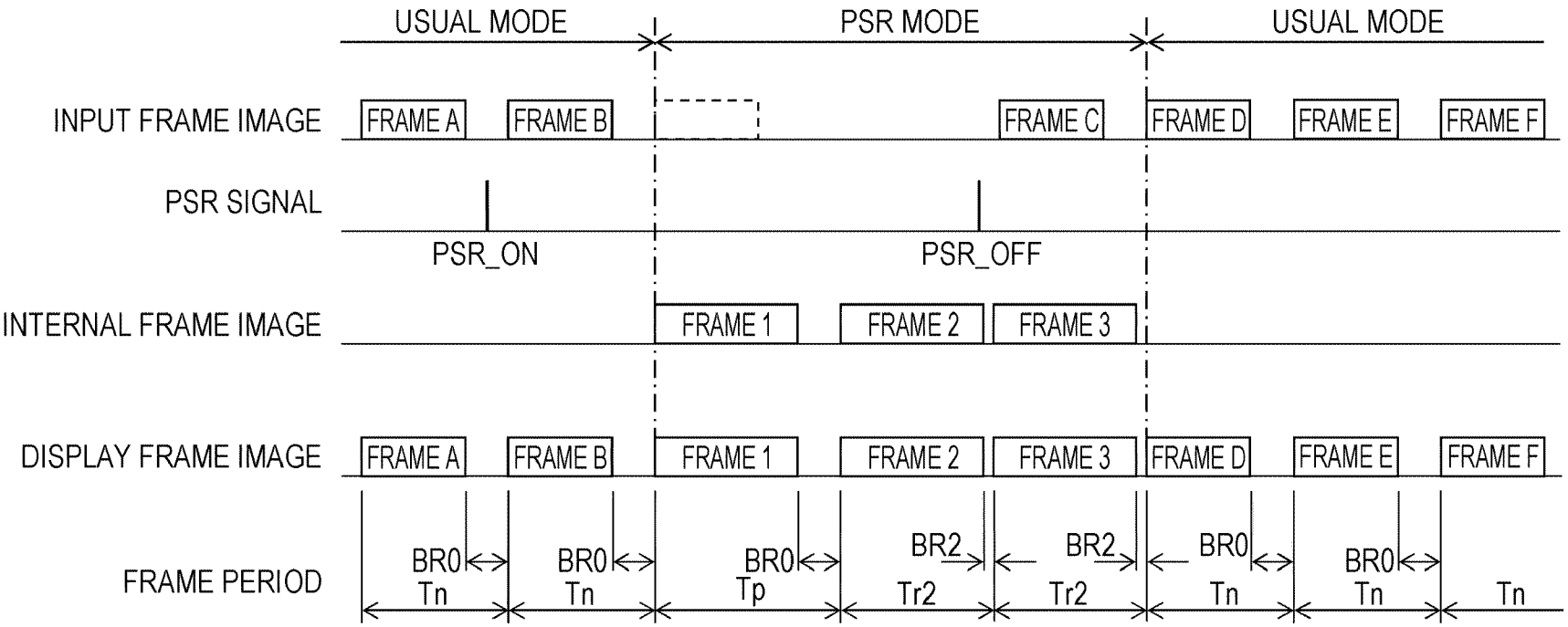
FIG. 5 is an example of various pieces of data input to and output from an image processing controller of a first embodiment in time series.

In a liquid crystal display device 200 according to a first exemplary embodiment, the determination processor 16 adjusts the vertical retrace period of the frame image data, and inserts (interpolates) the frame image data (the image data of the frame 3) (interpolation image data) indicating a still image in the blanking period BR1 of FIG. 3. FIG. 5 illustrates a state in which the image data of the frame 3 is inserted in the blanking period BR1.

The determination processor 16 determines whether the frame image data can be inserted in the blanking period BR1 of FIG. 3 by adjusting the vertical retrace period of the frame image data indicating the still image. For example, the determination processor 16 determines whether the image data of the frame 3 can be inserted in the blanking period BR1 by setting the vertical retrace periods of the frames 2 and 3 to the vertical retrace period BRx of the threshold. The vertical retrace period BRx of the threshold is a threshold period that becomes a critical value without affecting the display quality, and the vertical retrace period BRx is set according to the property of the display panel 40.

The determination processor 16 outputs a determination result to the data acquisition unit 14. When the image data of the frame 3 can be inserted in the blanking period BR1, the determination processor 16 outputs the control signal (for example, the gate start pulse GSP) controlling the vertical retrace period to the gate line driving circuit 30 at a desired timing, and sets the vertical retrace periods of the frames 2 and 3 to a desired period (for example, vertical retrace period BR2 (BRx≤BR2<BR1)).

Based on the determination result, the data acquisition unit 14 acquires the frame image data, and outputs the acquired frame image data to the data line driving circuit 20. When the image data of the frame 3 can be inserted in the blanking period BR1, the data acquisition unit 14 acquires the image data of the frame 3 after acquiring the image data of the frame 2. On the other hand, when the image data of the frame 3 cannot be inserted in the blanking period BR1, the data acquisition unit 14 acquires the image data of the frame D after acquiring the image data of the frame 2.

Figure 6:
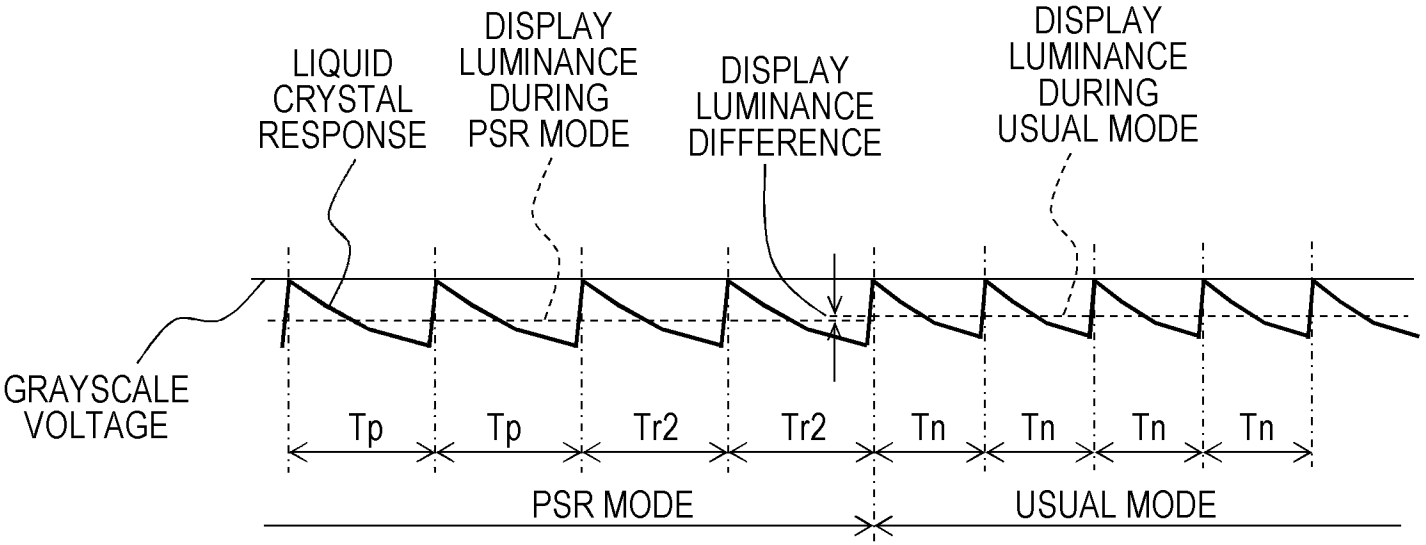
FIG. 6 is a graph illustrating a change in display luminance on the display screen of the liquid crystal display device of the first embodiment.

FIG. 5 illustrates a time-series example of various pieces of data input to and output from the image processing controller 10 when the image data of the frame 3 can be inserted in the blanking period BR1. FIG. 6 is a graph illustrating a change in display luminance on the display screen of the liquid crystal display device 200 of the first exemplary embodiment. FIG. 6 schematically illustrates a change in liquid crystal response and the display luminance in the case where the image having the same grayscale is displayed in the usual mode and the PSR mode. In FIG. 6, a dotted line illustrates the apparent display luminance (average luminance in each frame). A subsequent graph illustrating the change in display luminance is similar to that in FIG. 6.

In the example of FIG. 5, frame periods Tr2 of the two frames (frames 2 and 3) immediately before the switching from the PSR mode to the usual mode are shorter than a frame period Tq in FIG. 3 of the frame immediately before the switching from the PSR mode to the usual mode. Accordingly, as illustrated in FIG. 6, the change in display luminance (display luminance difference) decreases in the frame (the frame D in FIG. 3) immediately after the switching from the PSR mode to the usual mode. Therefore, the flicker caused by the display luminance difference can be reduced compared with the conventional configuration. In the liquid crystal display device 200 according to the first exemplary embodiment, preferably the vertical retrace period is adjusted while a writing time duration corresponding to the frame image data is kept constant.

Figure 7:
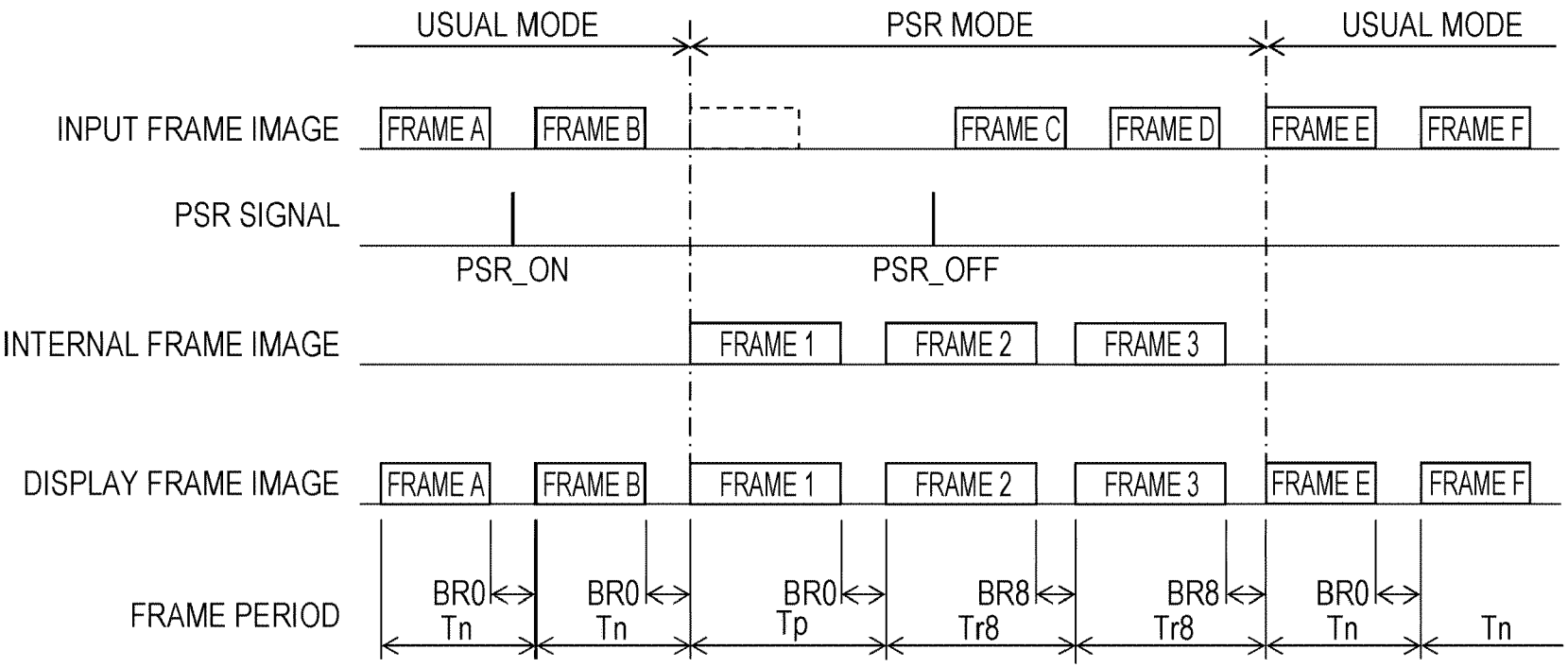
FIG. 7 is an example of various pieces of data input to and output from the image processing controller of the first embodiment in time series.

As illustrated in FIG. 7, in the case where timing to receive the second control signal PSR_OFF is located in a first half of the frame period corresponding to the frame 2, the data acquisition unit 14 may acquire the image data of the frame E after acquiring the image data of the frame 3. In the example of FIG. 7, the vertical retrace periods of the frames 2 and 3 are set to BR8 (<BR1).

Second Exemplary Embodiment

Figure 8:
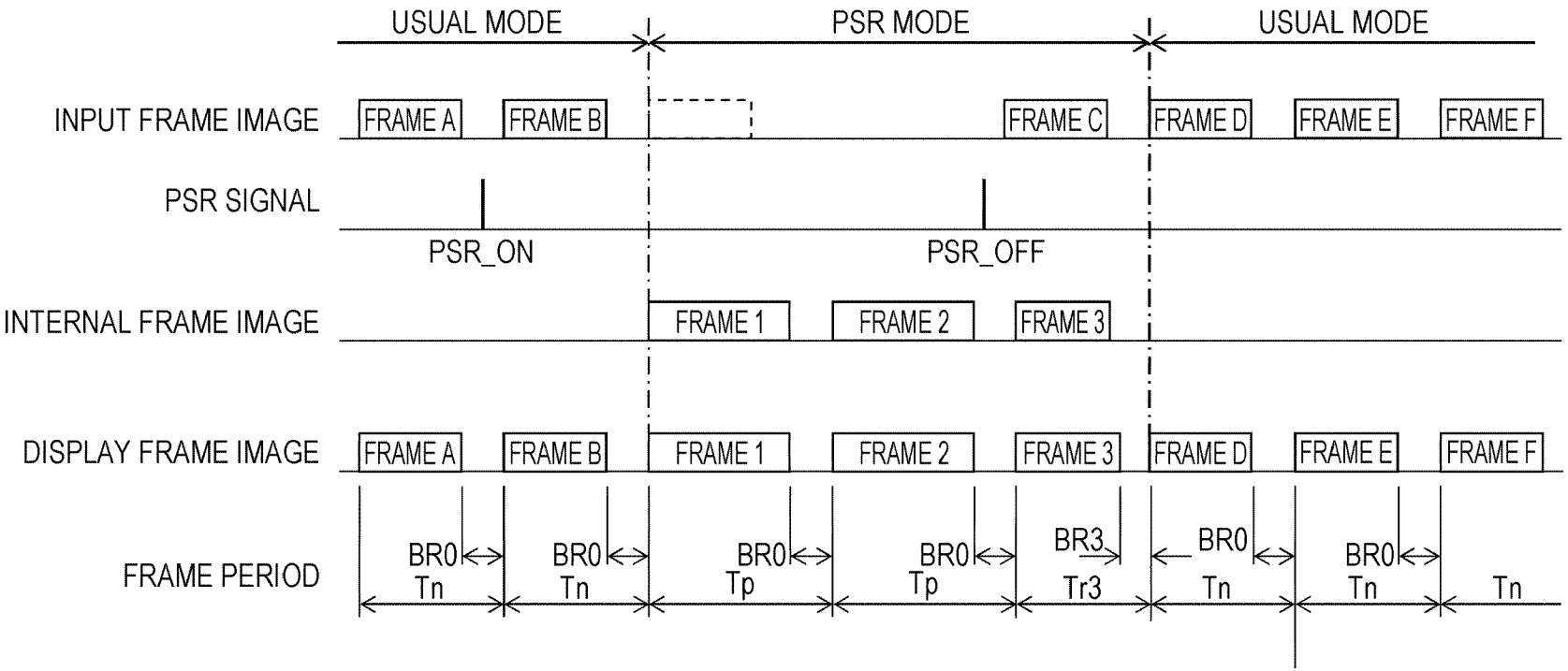
FIG. 8 is an example of various pieces of data input to and output from an image processing controller of a second embodiment in time series.

In a liquid crystal display device 200 according to a second exemplary embodiment, the determination processor 16 adjusts the horizontal retrace period of the frame image data, and inserts the frame image data (the image data of the frame 3) indicating the still image in the blanking period BR1 of FIG. 3. FIG. 8 illustrates a state in which the image data of the frame 3 is inserted in the blanking period BR1.

The determination processor 16 determines whether the frame image data can be inserted in the blanking period BR1 of FIG. 3 by adjusting the horizontal retrace period of the frame image data indicating the still image. For example, the determination processor 16 determines whether the image data of the frame 3 can be inserted in the blanking period BR1 by setting the horizontal retrace period of each line in the frame 3 to the horizontal retrace period of the threshold. The horizontal retrace period of the threshold is a threshold period that becomes a critical value without affecting the display quality, and the horizontal retrace period is set depending on the property of the display panel 40.

The determination processor 16 outputs a determination result to the data acquisition unit 14. When the image data of the frame 3 can be inserted in the blanking period BR1, the determination processor 16 outputs the control signal (for example, the data start pulse DSP) controlling the horizontal retrace period to the data line driving circuit 20 at a desired timing, and sets the horizontal retrace period of the frame 3 to a desired period (for example, at least the horizontal retrace period of the threshold).

Based on the determination result, the data acquisition unit 14 acquires the frame image data, and outputs the acquired frame image data to the data line driving circuit 20. When the image data of the frame 3 can be inserted in the blanking period BR1, the data acquisition unit 14 acquires the image data of the frame 3 after acquiring the image data of the frame 2. On the other hand, when the image data of the frame 3 cannot be inserted in the blanking period BR1, the data acquisition unit 14 acquires the image data of the frame D after acquiring the image data of the frame 2.

Figure 9:
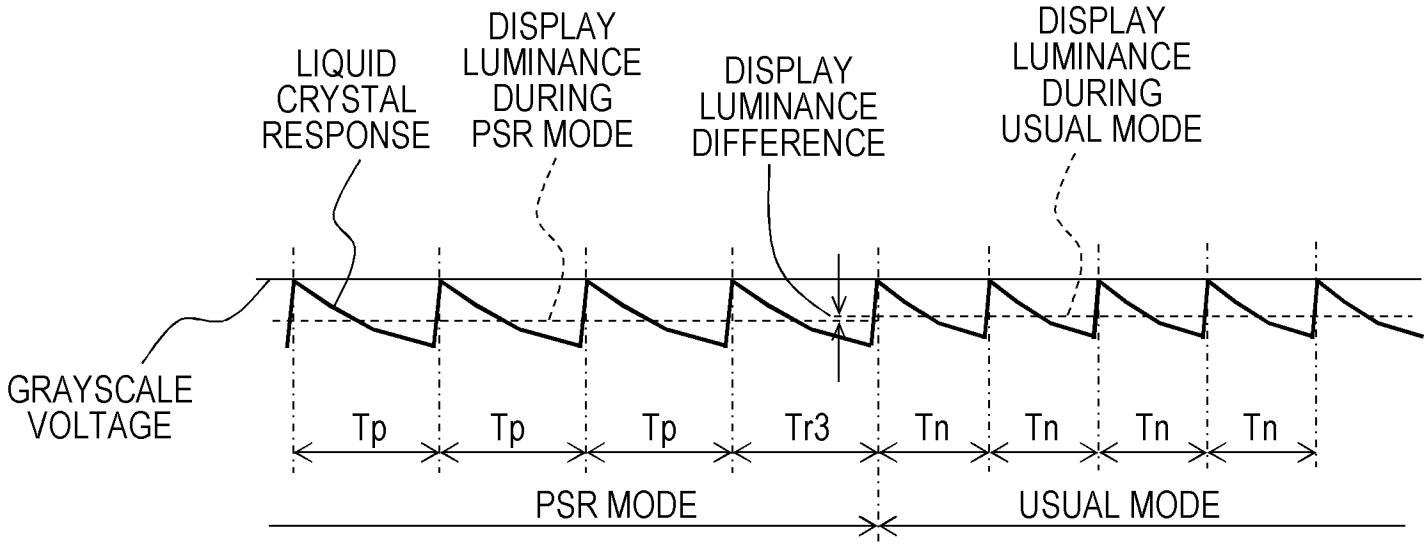
FIG. 9 is a graph illustrating a change in display luminance on the display screen of the liquid crystal display device of the second embodiment.

FIG. 8 illustrates a time-series example of various pieces of data input to and output from the image processing controller 10 when the image data of the frame 3 can be inserted in the blanking period BR1. FIG. 9 is a graph illustrating the change in display luminance on the display screen of the liquid crystal display device 200 of the second exemplary embodiment. In the example of FIG. 8, the vertical retrace period is set to BR3 (BR3<BR0) in the association with the adjustment of the horizontal scan period of each line in the image data of the frame 3. Alternatively, the vertical retrace period of the frame 3 may be set to BR0.

In the example of FIG. 8, a frame period Tr3 of the frame 3 immediately before the switching from the PSR mode to the usual mode is shorter than the frame period Tq in FIG. 3 of the frame immediately before the switching from the PSR mode to the usual mode. Accordingly, as illustrated in FIG. 9, the change in display luminance (display luminance difference) decreases in the frame (the frame D in FIG. 8) immediately after the switching from the PSR mode to the usual mode. Therefore, the flicker caused by the display luminance difference can be reduced compared with the conventional configuration.

Third Exemplary Embodiment

Figure 10:
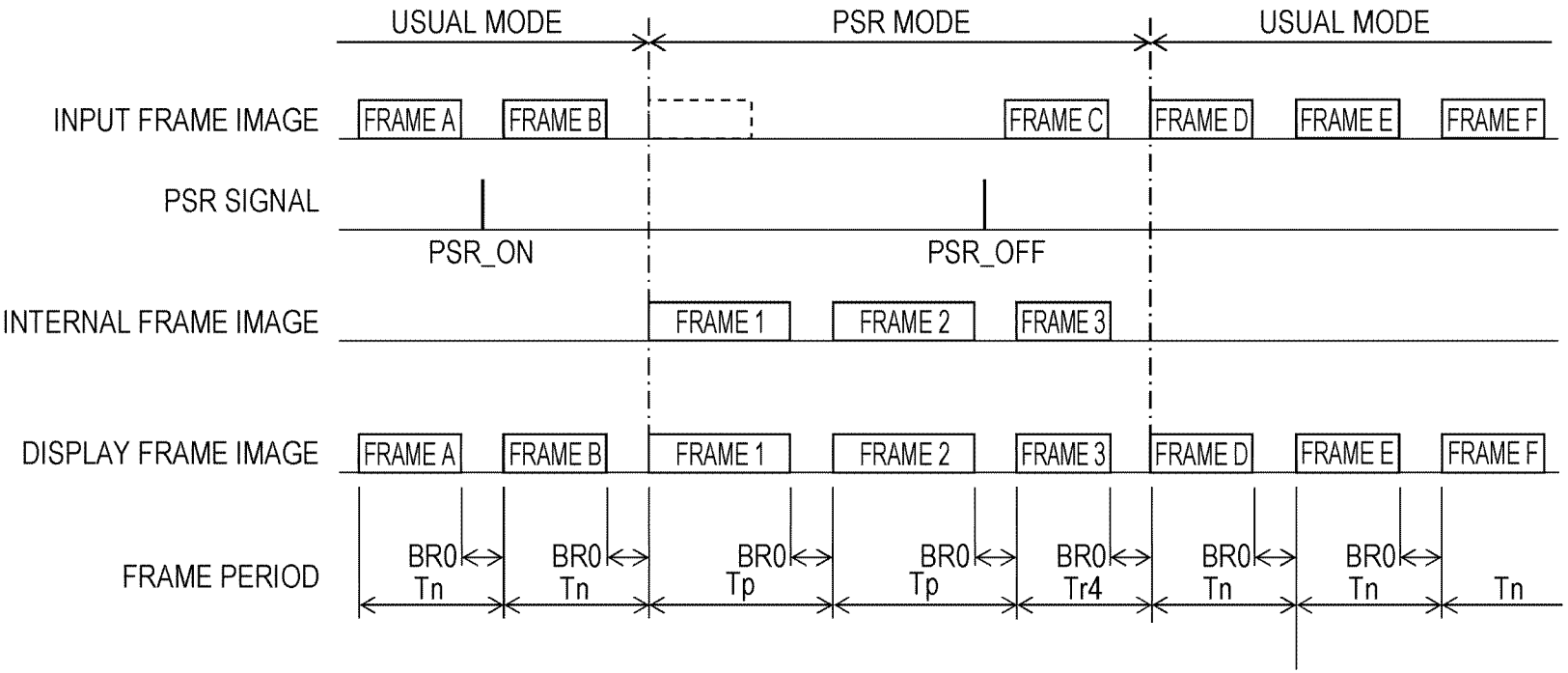
FIG. 10 is an example of various pieces of data input to and output from the image processing controller of a third embodiment in time series.

In a liquid crystal display device 200 according to a third exemplary embodiment, the determination processor 16 adjusts the clock frequency of the frame image data, and inserts the frame image data (the image data of the frame 3) indicating a still image in the blanking period BR1 of FIG. 3. FIG. 10 illustrates a state in which the image data of the frame 3 is inserted in the blanking period BR1.

The determination processor 16 determines whether the frame image data can be inserted in the blanking period BR1 of FIG. 3 by adjusting the clock frequency of the frame image data indicating a still image. For example, the determination processor 16 determines whether the image data of the frame 3 can be inserted in the blanking period BR1 by setting the clock frequency corresponding to the image data of the frame 3 to the clock frequency of the threshold. The clock frequency of the threshold is a threshold frequency that becomes a critical value without affecting the display quality, and the clock frequency is set depending on the property of the display panel 40.

The determination processor 16 outputs a determination result to the data acquisition unit 14. When the image data of the frame 3 can be inserted in the blanking period BR1, the determination processor 16 outputs the control signal (for example, the data clock DCK and the gate clock GCK) controlling the clock frequency to the data line driving circuit 20 and the gate line driving circuit 30 at a desired timing, and sets the clock frequency of the image data of the frame 3 to a desired frequency (for example, at least the clock frequency of the threshold).

Based on the determination result, the data acquisition unit 14 acquires the frame image data, and outputs the acquired frame image data to the data line driving circuit 20. When the image data of the frame 3 can be inserted in the blanking period BR1, the data acquisition unit 14 acquires the image data of the frame 3 after acquiring the image data of the frame 2. On the other hand, when the image data of the frame 3 cannot be inserted in the blanking period BR1, the data acquisition unit 14 acquires the image data of the frame D after acquiring the image data of the frame 2.

Figure 11:
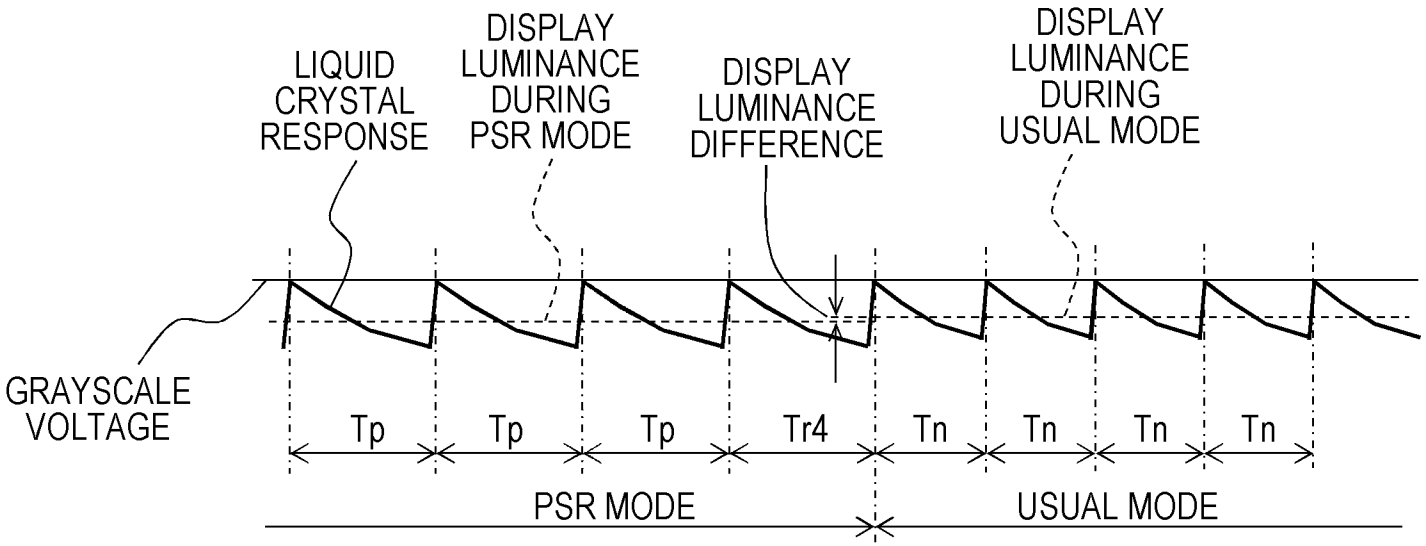
FIG. 11 is a graph illustrating a change in display luminance on the display screen of the liquid crystal display device of the third embodiment.

FIG. 10 illustrates a time-series example of various pieces of data input to and output from the image processing controller 10 when the image data of the frame 3 can be inserted in the blanking period BR1. FIG. 11 is a graph illustrating the change in display luminance on the display screen of the liquid crystal display device 200 according to the third exemplary embodiment.

In the example of FIG. 11, a frame period Tr4 of the frame 3 immediately before the switching from the PSR mode to the usual mode is shorter than the frame period Tq in FIG. 3 of the frame immediately before the switching from the PSR mode to the usual mode. Accordingly, as illustrated in FIG. 11, the change in display luminance (display luminance difference) decreases in the frame (the frame D in FIG. 10) immediately after the switching from the PSR mode to the usual mode. Therefore, the flicker caused by the display luminance difference can be reduced compared with the conventional configuration.

Fourth Exemplary Embodiment

Figure 12:
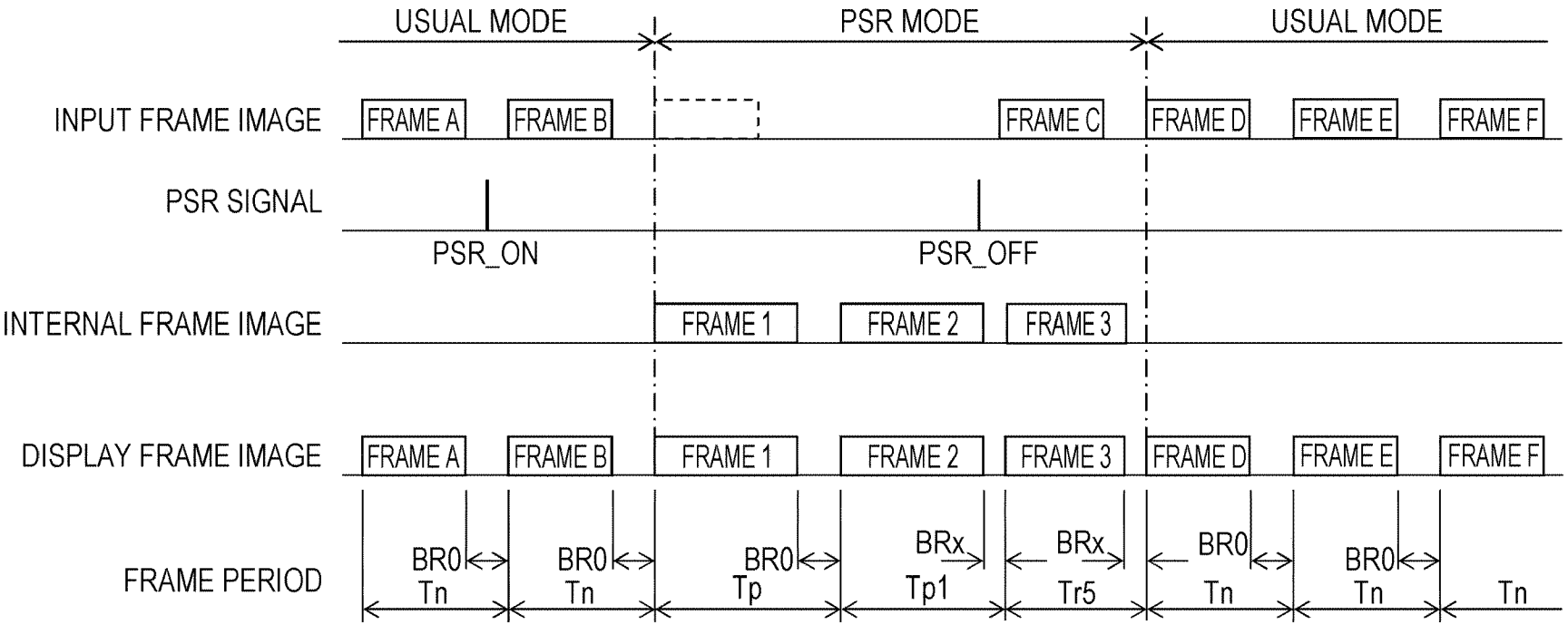
FIG. 12 illustrates an example of various pieces of data input to and output from an image processing controller of a fourth embodiment in time series.

A liquid crystal display device 200 according to a fourth exemplary embodiment may include at least one of the configurations of the first to third exemplary embodiments. That is, the liquid crystal display device 200 of the fourth exemplary embodiment may be configured by a proper combination of the first to third exemplary embodiments. For example, in the liquid crystal display device 200 according to the fourth exemplary embodiment, the vertical retrace period and clock frequency of the frame image data are adjusted to insert the frame image data (the image data of the frame 3) indicating a still image in the blanking period BR1 of FIG. 3. FIG. 12 illustrates a state in which the image data of the frame 3 is inserted in the blanking period BR1.

The determination processor 16 determines whether the frame image data can be inserted in the blanking period BR1 of FIG. 3 by adjusting the vertical retrace period of the frame image data indicating a still image (first determination processing). For example, the determination processor 16 determines whether the image data of the frame 3 can be inserted in the blanking period BR1 by setting the vertical retrace periods of the frames 2 and 3 to the vertical retrace period BRx of the threshold. When the image data of the frame 3 cannot be inserted in the blanking period BR1, the determination processor 16 determines whether the frame image data indicating a still image can be inserted in the blanking period BR1, which is calculated based on the vertical retrace period BRx, by further adjusting the clock frequency in the state in which the vertical retrace periods of the frames 2 and 3 are set to the vertical retrace period BRx (second determination processing).

Then the determination processor 16 outputs the determination result of the second determination processing to the data acquisition unit 14. When the image data of the frame 3 can be inserted in the blanking period BR1 with respect to the second determination processing, the determination processor 16 outputs the control signal (for example, the gate start pulse GSP) controlling the vertical retrace period to the gate line driving circuit 30 at a desired timing, and outputs the control signal (for example, the data clock DCK and the gate clock GCK) controlling the clock frequency to the data line driving circuit 20 and the gate line driving circuit 30 at a desired timing. Therefore, the vertical retrace periods of the frames 2 and 3 are set to the vertical retrace period BRx, and the clock frequency of the image data of the frame 3 is set to a desired frequency (for example, at least the clock frequency of the threshold).

Based on the determination result of the second determination processing, the data acquisition unit 14 acquires the frame image data, and outputs the acquired frame image data to the data line driving circuit 20. When the image data of the frame 3 can be inserted in the blanking period BR1 with respect to the second determination processing, the data acquisition unit 14 acquires the image data of the frame 3 after acquiring the image data of the frame 2. On the other hand, when the image data of the frame 3 cannot be inserted in the blanking period BR1 with respect to the second determination processing, the data acquisition unit 14 acquires the image data of the frame D after acquiring the image data of the frame 2.

Figure 13:
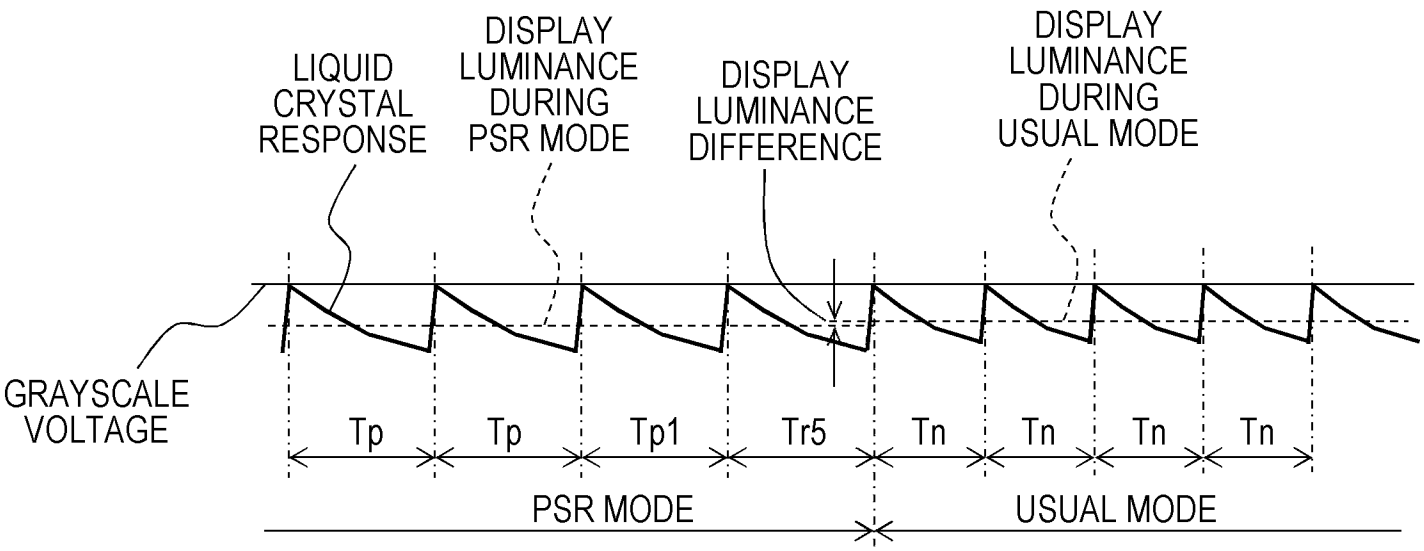
FIG. 13 is a graph illustrating a change in display luminance on the display screen of the liquid crystal display device of the fourth embodiment.

FIG. 12 illustrates a time-series example of various pieces of data input to and output from the image processing controller 10 when the image data of the frame 3 can be inserted in the blanking period BR1 with respect to the second determination processing. FIG. 13 is a graph illustrating the change in display luminance on the display screen of the liquid crystal display device 200 according to the fourth exemplary embodiment.

In the example of FIG. 13, a frame period Tr5 of the frame 3 immediately before the switching from the PSR mode to the usual mode is shorter than the frame period Tq in FIG. 3 of the frame immediately before the switching from the PSR mode to the usual mode. Accordingly, as illustrated in FIG. 13, the change in display luminance (display luminance difference) decreases in the frame (the frame D in FIG. 12) immediately after the switching from the PSR mode to the usual mode. Therefore, the flicker caused by the display luminance difference can be reduced compared with the conventional configuration.

Fifth Exemplary Embodiment

In the configurations of the first to fourth exemplary embodiments, the image data (the image data of the frame 3) for one frame indicating a still image is inserted in the blanking period BR1 of FIG. 3. However, the configuration of the liquid crystal display device 200 is not limited to the first to fourth exemplary embodiments. For example, in the liquid crystal display device 200, the determination processor 16 may adjust at least one of the vertical retrace period, the horizontal retrace period, and the clock frequency, and insert the image data for a plurality of frames indicating a still image in the blanking period BR1 of FIG. 3.

Figure 14:
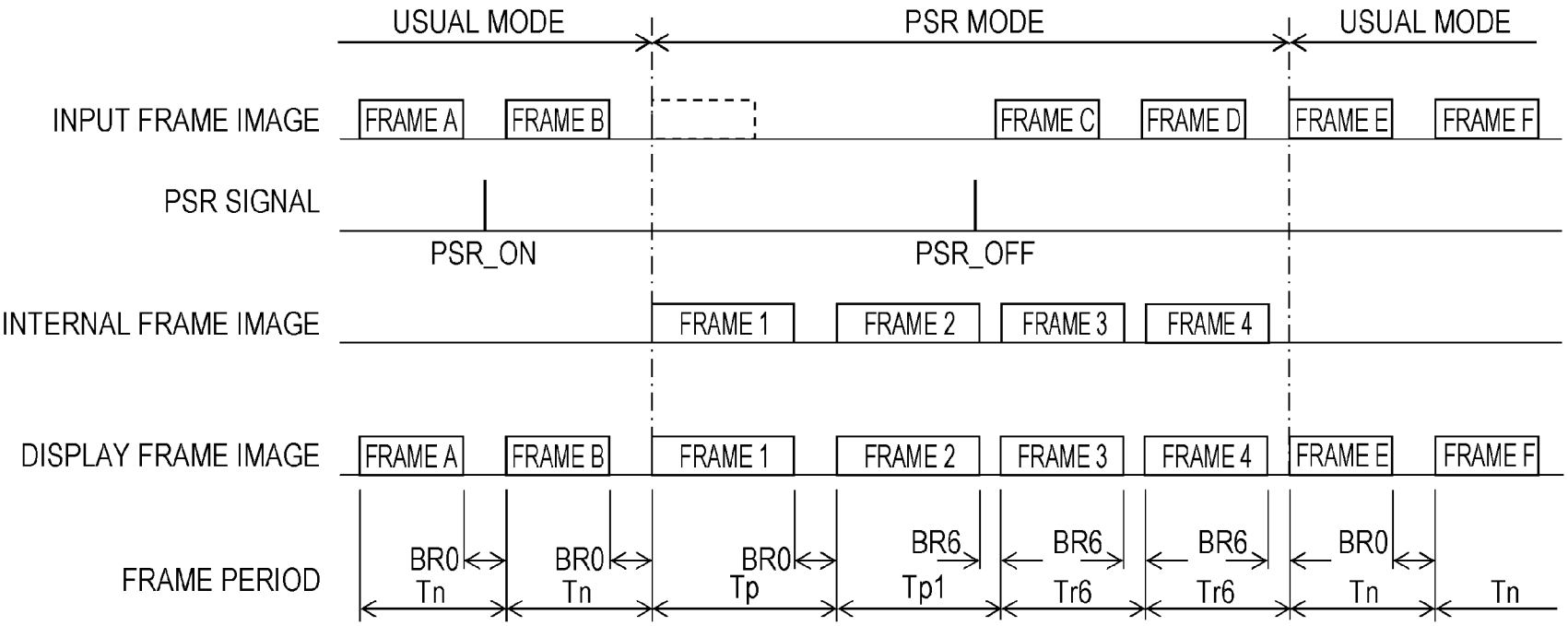
FIG. 14 is an example of various pieces of data input to and output from an image processing controller of a fifth embodiment in time series.

FIG. 14 illustrates a time-series example of various pieces of data input to and output from the image processing controller 10 of the liquid crystal display device 200 according to the fifth exemplary embodiment. In the example of FIG. 14, the pieces of image data (still image) (interpolation image data) of the frames 3 and 4 are inserted in the blanking period BR1 of FIG. 3, the vertical retrace periods of the frames 2 to 4 are set to a desired period (for example, vertical retrace period BR6 (BRx≤BR6<BR1)), and the clock frequencies of the pieces of image data of the frames 3 and 4 are set to a desired frequency (for example, at least the clock frequency of the threshold).

Figure 15:
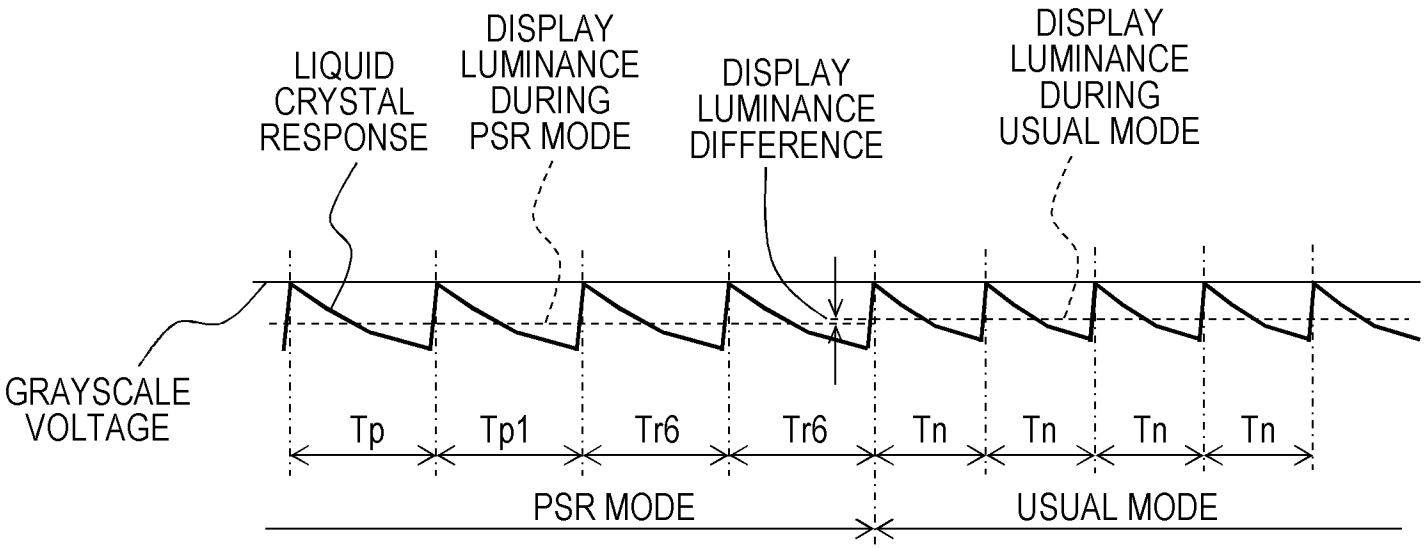
FIG. 15 is a graph illustrating a change in display luminance on the display screen of the liquid crystal display device of the fifth embodiment.

In the example of FIG. 14, frame periods Tr6 of the two frames (frames 3 and 4) immediately before the switching from the PSR mode to the usual mode are shorter than the frame period Tq in FIG. 3 of the frame immediately before the switching from the PSR mode to the usual mode. Therefore, as illustrated in FIG. 15, the change in display luminance (display luminance difference) decreases in the frame (the frame E in FIG. 14) immediately after the switching from the PSR mode to the usual mode. The frame image data of the still image inserted in the blanking period BR1 may be the image data for two frames (in FIG. 14, the frames 3 and 4) or at least three frames.

The liquid crystal display device 200 according to the fifth exemplary embodiment is not limited to the above configuration.

For example, in the case where the blanking period BR1 in FIG. 3 is greater than or equal to the frame period Tp of the frame image data (the image data corresponding to the frame B) indicating a still image (Tp≤BR1), the frame image data (for example, the image data of the frame 3) indicating a still image may be inserted in the blanking period BR1 without adjusting the vertical retrace period, the horizontal retrace period, and the clock frequency.

Figure 16:
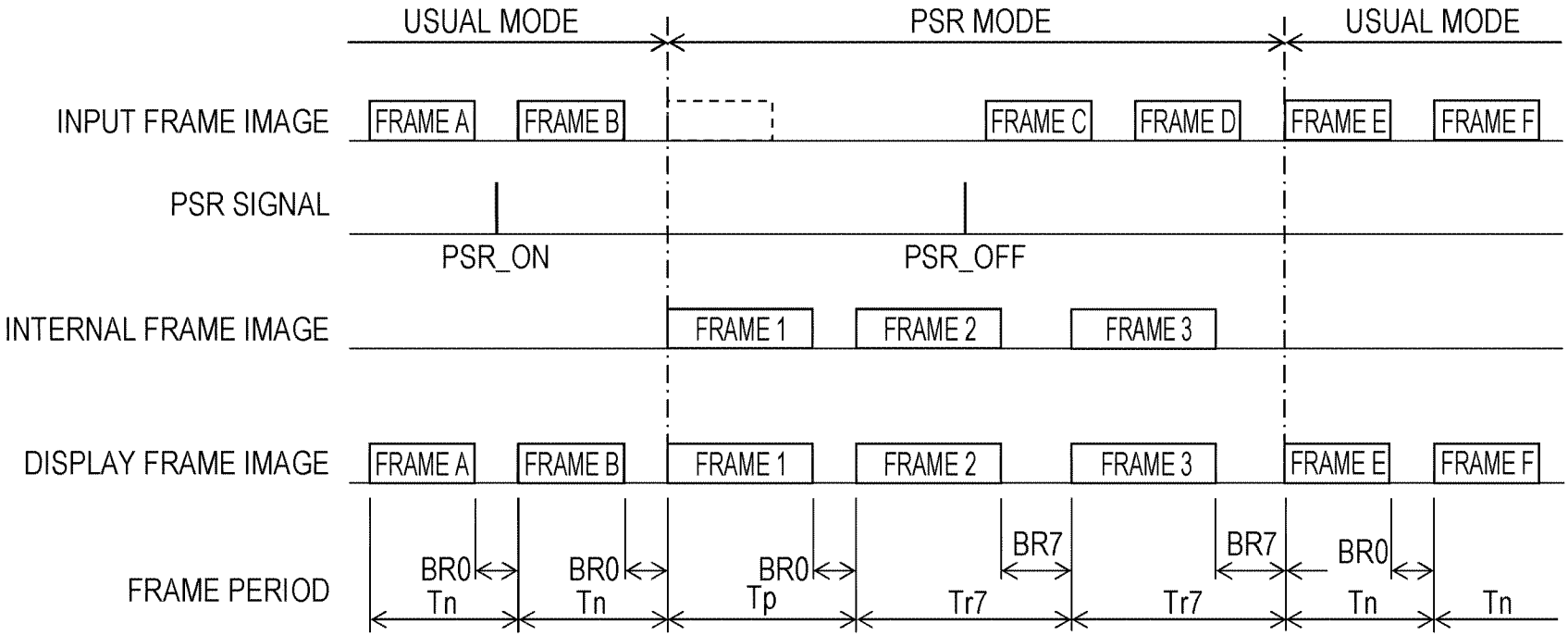
FIG. 16 is a graph illustrating a change in display luminance on a display screen of a liquid crystal display device of another embodiment.

In the first to fifth exemplary embodiments, when the image data (for example, the image data of the frame 3 in FIG. 5) indicating a still image cannot be inserted in the blanking period BR1 of FIG. 3 (the negative determination in the determination result), the image data of the frame 3 is inserted instead of the image data of the frame D indicating a moving image, and the determination processor 16 may adjust at least one of the vertical retrace period, the horizontal retrace period, and the clock frequency, and lengthen the frame period of the one or plurality of frames before the switching from the PSR mode to the usual mode. For example, as illustrated in FIG. 16, the determination processor 16 outputs the control signal (for example, the gate start pulse GSP) controlling the vertical retrace period to the gate line driving circuit 30 at a desired timing, and sets the vertical retrace periods of the frames 2 and 3 to a desired period (for example, vertical retrace period BR7 (BR0<BR7<BR1)). A frame period Tr7 of the frame immediately before the switching from the PSR mode to the usual mode is shorter than the frame period Tq in FIG. 3 of the frame immediately before the switching from the PSR mode to the usual mode. Therefore, the change in display luminance (display luminance difference) decreases in the frame (the frame E in FIG. 16) immediately after the switching from the PSR mode to the usual mode. In the example of FIG. 16, although the frame period of the frame 2 is also lengthened, the change in display luminance decreases between the frames 2 and 3 and between frames 2 and E.

In the case where the blanking period longer than a predetermined period is generated, the determination processor 16 may adjust at least one of the vertical retrace period, the horizontal retrace period, and the clock frequency such that the blanking period is dispersed into the plurality of frames. The configuration in FIG. 16 can be applied also when the image data indicating a still image can be inserted in the blanking period BR1 of FIG. 3 (the affirmative determination in the determination result).

The liquid crystal display device 200 of the fifth exemplary embodiment may select one of the above configurations according to the determination result of the determination processor 16, and implement the selected configuration. For example, in the case where the blanking period in FIG. 3 becomes a period equal to or larger than a half of the frame period Tp of the frame image data corresponding to a still image, at least one of the vertical retrace period, the horizontal retrace period, and the clock frequency may be adjusted to insert (interpolate) the image data of a still image.

The configuration in which the vertical retrace period and the horizontal retrace period are adjusted is not limited to the above configuration. For example, the vertical retrace period may be adjusted by adjusting a high-level period of a vertical synchronous signal (VSYNC). For example, the horizontal retrace period may be adjusted by adjusting a high-level period of a horizontal synchronous signal (HSYNC).

In each of the configurations, by way of an example, the image data indicating a still image is inserted in the blanking period BR1 of FIG. 3. However, the liquid crystal display device 200 according to the fifth exemplary embodiment is not limited to the configuration in which the image data indicating a still image is inserted in the blanking period BR1 of FIG. 3. For example, in the liquid crystal display device 200, the image data indicating a moving image is inserted in the blanking period BR1 of FIG. 3, and at least one of the vertical retrace period, the horizontal retrace period, and the clock frequency may be adjusted in the image data.

As described above, the determination processor 16 acts as an adjuster that adjusts at least one of the vertical retrace period, the horizontal retrace period, and the clock frequency. The data acquisition unit 14 acts as an interpolator that inserts (interpolates) the frame image data in the blanking period.

Although the exemplary embodiments of the present disclosure are described above, the display device of the present disclosure is not limited to the exemplary embodiments. It is noted that an exemplary embodiment properly changed from the exemplary embodiments by those skilled in the art without departing from the scope of the present disclosure is included in the present disclosure.

What is claimed is:

1. A display device comprising:

a processor that performs processing on each frame of image data that includes plural frames, the display device displaying an image on a display screen based on the image data processed by the processor, wherein the processor receives the image data, a first control signal indicating a command to stop output of the image data, and a second control signal indicating a command to perform the output of the image data; and a memory in which the image data received immediately before stop of transmission of the image data is stored as internal image data, wherein the processor includes:

a first display mode in which the processor displays the image on the display screen from the internal image data after the processor receives the first control signal; and a second display mode in which the processor displays the image on the display screen from the image data received by the processor after the processor receives the second control signal, wherein the display device further comprises:

a calculator that calculates a blanking period between a writing end time point of the internal image data corresponding to a final frame immediately before switching from the first display mode to the second display mode and a writing start time point of the image data corresponding to an initial frame immediately after switching from the first display mode to the second display mode; and an adjuster that adjusts at least one of a vertical retrace period, a horizontal retrace period, and a clock frequency, which correspond to the internal image data, depending on the blanking period.

2. The display device according to claim 1, wherein the adjuster keeps a writing time duration corresponding to the internal image data constant, and adjusts the vertical retrace period corresponding to the internal image data.

3. The display device according to claim 1, wherein the adjuster adjusts at least one of the vertical retrace period, the horizontal retrace period, and the clock frequency such that the vertical retrace period corresponding to the internal image data corresponding to the final frame is shorter than the blanking period.

4. A display device comprising:

a processor that performs processing on each frame of image data that includes plural frames, the display device displaying an image on a display screen based on the image data processed by the processor, wherein the processor receives the image data, a first control signal indicating a command to stop output of the image data, and a second control signal indicating a command to perform the output of the image data; and a memory in which the image data received immediately before stop of transmission of the image data is stored as internal image data, wherein the processor includes:

a first display mode in which the processor displays the image on the display screen from the internal image data after the processor receives the first control signal; and a second display mode in which the processor displays the image on the display screen from the image data received by the processor after the processor receives the second control signal, wherein the display device further includes:

a calculator that calculates a blanking period between a writing end time point of the internal image data corresponding to a final frame immediately before switching from the first display mode to the second display mode and a writing start time point of the image data corresponding to an initial frame immediately after switching from the first display mode to the second display mode; and an interpolator that interpolates interpolation image data based on the internal image data in the blanking period when the blanking period is larger than a predetermined period.

5. The display device according to claim 4, wherein the interpolator further adjusts at least one of the vertical retrace period, the horizontal retrace period, and the clock frequency, which correspond to the interpolation image data, depending on the blanking period.

6. The display device according to claim 5, wherein the interpolator interpolates the interpolation image data when the blanking period becomes equal to or larger than a half of one frame period of the internal image data.

7. The display device according to claim 5, wherein the interpolator adjusts at least one of the vertical retrace period, the horizontal retrace period, and the clock frequency such that the vertical retrace period corresponding to the internal image data corresponding to the final frame is shorter than the blanking period.

8. A method for driving a display device including a processor that performs processing on each frame of image data that includes plural frames, the display device displaying an image on a display screen based on the image data processed by the processor, said method comprising:

receiving, with the processor, the image data, a first control signal indicating a command to stop output of the image data, and a second control signal indicating a command to perform the output of the image data; and storing as internal image data in a memory the image data received immediately before stop of transmission of the image data, wherein the processor includes: a first display mode in which the processor displays the image on the display screen from the internal image data after the processor receives the first control signal; and a second display mode in which the processor displays the image on the display screen from the image data received by the processor after the processor receives the second control signal, wherein the processor calculates a blanking period between a writing end time point of the internal image data corresponding to a final frame immediately before switching from the first display mode to the second display mode and a writing start time point of the image data corresponding to an initial frame immediately after switching from the first display mode to the second display mode, and adjusts at least one of a vertical retrace period, a horizontal retrace period, and a clock frequency, which correspond to the internal image data, depending on the blanking period.

* * * * *